US005322199A

United States Patent [19]

White

[11] Patent Number: 5,322,199

[45] Date of Patent: Jun. 21, 1994

[54] APPARATUS FOR ASSISTING A PERSON IN PUTTING ON A STOCKING

[76] Inventor: Carl White, 101 W. Cypress St., Compton, Calif. 90220

[21] Appl. No.: 106,887

[22] Filed: Aug. 16, 1993

[51] Int. Cl.[5] ..... A47G 25/80

[52] U.S. Cl. ..... 223/111; 223/112

[58] Field of Search ..... 223/111, 112, 118; 128/394

[56] References Cited

U.S. PATENT DOCUMENTS 4,991,757 2/1991 Deakyne ..... 223/112
5,050,783 9/1991 Hunter ..... 223/112

FOREIGN PATENT DOCUMENTS 1079238 6/1980 Canada ..... 223/111
7320173 2/1977 France ..... 223/111
97131 10/1960 Norway ..... 223/111

*Primary Examiner*—Clifford D. Crowder
*Assistant Examiner*—Bibhu Mohanty
*Attorney, Agent, or Firm*—Erik M. Arnhem

[57] ABSTRACT

Persons with back problems have trouble putting on their stockings without experiencing some back pain or stress. An apparatus is provided for enabling the person to put on his stockings without bending or stooping; the person thereby avoids the back pain associated with such bending. An arcuate hollow form is releasably attached to the upper edge of a stocking by clamp elements located at spaced points on the hollow form. Elongated straps extend from the clamping points, such that the person can pull the hollow form over the foot and up onto the leg without bending or stooping.

4 Claims, 2 Drawing Sheets

APPARATUS FOR ASSISTING A PERSON IN PUTTING ON A STOCKING

BACKGROUND OF THE INVENTION

1. Field of the Invention

This invention relates to an apparatus for assisting a person in putting a stocking on his or her foot. The apparatus comprises two flexible straps that can be pulled to draw a stocking over a person's foot and around his or her leg.

2. Prior Developments

The process of putting a stocking on a person's foot normally involves some bending or stooping of the person. For example, a person sitting on a bed or chair is required to reach forward and downward in order to place a stocking over his or her toes. While the person remains in the bent-over position he or she is required to pull the stocking over the foot and onto the leg in order to complete the process.

Persons afflicted with back problems and hip problems frequently experience pain when bending over to put on their stockings. The present invention is concerned with a portable apparatus that can be attached to a stocking in preparing for putting on a stocking whereby the process of putting on a stocking is less painful and stressful.

SUMMARY OF THE INVENTION

The invention concerns an apparatus that includes an arcuate hollow form adapted to encircle at least a portion of a person's leg below the knee. The arcuate form can be an annular band formed of a flexible, but somewhat stiff material, such that the band can completely encircle a person's leg (at about calf height). Alternatively, the arcuate form can be a hollow arcuate band or strip adapted to partially encircle the person's leg. The size of the arcuate form is such that it can be placed within the opening in a conventional stocking, so as to provide a relatively large circumscribed space for insertion of a person's toe into the stocking. The arcuate form stabilizes the otherwise limp stocking, and somewhat increases the size of the toe opening; the arcuate form thereby makes it easier for the person to insert his or her toes into the stocking.

The apparatus further comprises two flexible straps designed for attachment to opposite side areas of the hollow arcuate form. Each strap carriers a clamp device for holding an upper edge area of the stocking against the arcuate form. In one form of the invention the clamp device can be a female snap fastener affixed to one end of a flexible strap; a mating male snap fastener is affixed to the outer surface of the arcuate form. To attach the stocking to the arcuate form, the person places the stocking fabric between the mating snap fasteners, and then exerts a squeezing pressure on the outer surface of the strap and the inner surface of the arcuate form. The mating fastener elements snap together (or interlock) so that the stocking fabric is effectively anchored to the arcuate form.

Each flexible strap is attached to the arcuate form and to an upper edge area of a conventional stocking, such that the stocking has an attachment to both straps. After the person has inserted his or her toes onto the space circumscribed by the arcuate form, the two straps can be pulled upwardly to draw the stocking over the foot and along the lower portion of the leg.

The straps can be readily reached by the person without stooping or bending over. Accordingly, the apparatus is useful by persons who have back problems or hip problems that would cause them to experience pain while bending over to manually pull on their stockings. The apparatus is designed for use with stockings that reach up to about calf height on the person's leg. The apparatus can be used by men or women; primary use would be by men who might be afflicted with arthritis or other painful conditions in their back muscles, ligaments or joints.

THE DRAWINGS

DESCRIPTION OF A PREFERRED EMBODIMENT OF THE INVENTION

Figure 1:
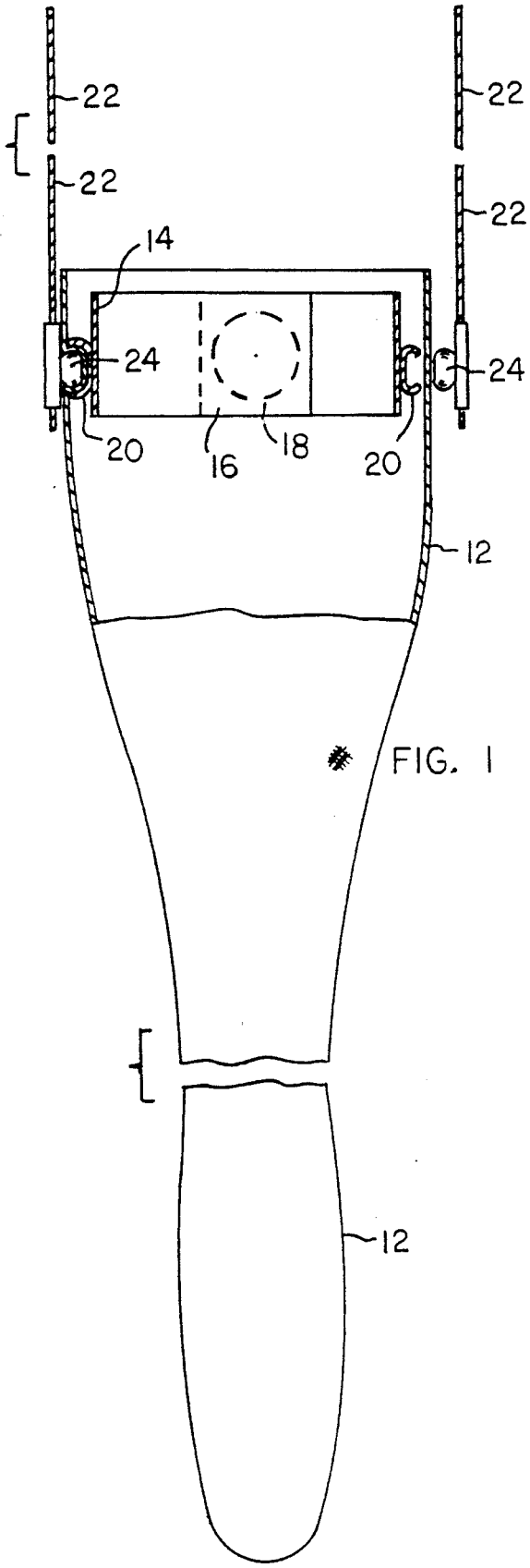
FIG. 1, is a sectional view taken through an apparatus constructed according to the invention. The apparatus is shown partially attached to a conventional fabric stocking.
Figure 2:
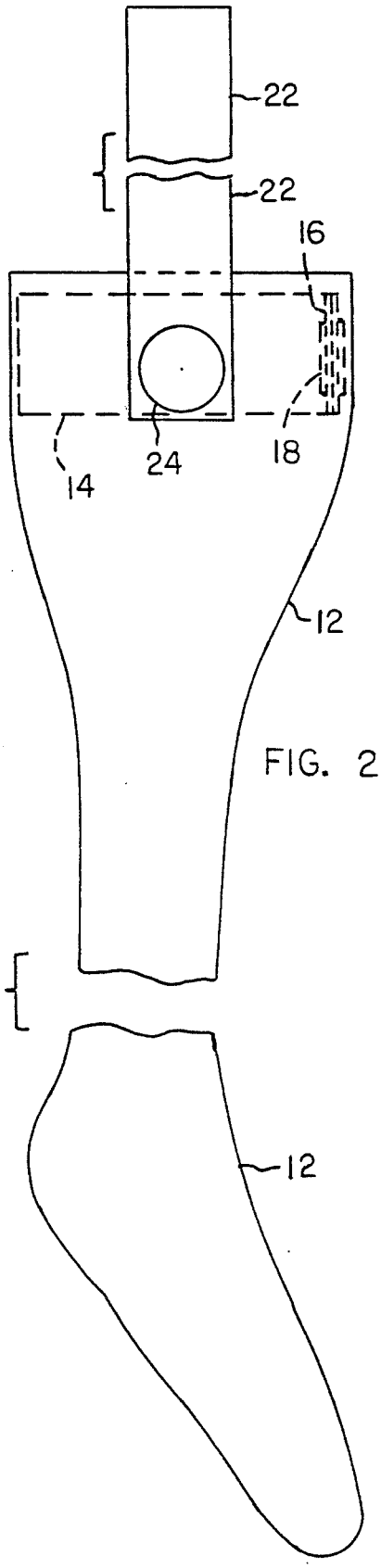
FIG. 2 is a side elevational view of the FIG. 1 apparatus.

FIGS. 1 and 2 show an apparatus for assisting a person during the process of putting on a stocking. The apparatus is shown partially attached to the upper edge area of a man's stocking 12. FIG. 1 shows the stocking in end elevation. FIG. 2 shows the stocking in side elevation.

The illustrated apparatus comprises an arcuate hollow form 14 constructed of a stiff flexible material, whereby the hollow form can have an annular ring-like configuration. The annular structure comprises a strip or band having end sections thereof overlapped, as at 16 in FIG. 1. Mating snap fastener elements 18 are affixed to the band overlapped sections, such that when the fastener elements are snapped together the band defines an endless annular flexible form. The length of the flexible band is sufficient that the annular form is enabled to fit around a person's leg at a point at or slightly below the calf area; typically the annular form has a circumferential length on the order of fourteen inches. The end sections of the flexible band may be connected together by means other than the mating snap fastener elements 18; e.g. fibrous hook-and-loop patches marketed under the trademark VELCRO can be used. The flexibility of the band enables the band material to better conform to the contours of a person's leg.

At spaced points around its circumference the flexible band mounts two female snap fastener elements 20. Two elongated flexible straps 22 have mating male snap fastener elements 24 secured thereto at their lower ends. Each male snap fastener element 24 is sized to interlock with an associated female fastener element 20 when the stocking fabric is interposed between the mating surfaces of the fastener elements. The female fastener elements 20 may be slightly oversize relative to the male fastener elements in order to take into account the thickness of the stocking fabric when designing the interlock surfaces.

In FIG. 1, the mating fastener elements at the left of the Figure are shown interlocked together; the mating fastener elements at the right of the Figure are shown detached. To attach the snap fastener elements together, manual squeezing forces can be applied to the inner surface of flexible band (form) 14 and the outer surface of strap 22. When the fastener elements 20 and 24 are interlocked together (as shown at the left in FIG. 1) the stocking material will be firmly attached to the annular form 14.

Straps 22 are preferably flexible. However, within the broader aspects of the invention, each strap could be a rigid, essentially non-flexible structure. Each strap has a preferred length of about twenty five inches.

Fastener elements 20 are located at diametrically spaced points on the hollow annular form 14, such that straps 22 are locatable along side areas of the person's leg, whereby the person can grasp the upper ends of the straps for the purpose of pulling the stocking over his or her foot and onto his or her leg.

The stocking is initially attached to hollow form 14 and straps 22 prior to manipulation of the apparatus for putting on the stocking. The arcuate hollow form 14 has sufficient stiffness as to provide an opening (or enclosed spaced) large enough for the person's toes to easily fit through the circumscribed space. The person can sit on a bed or chair, and position the limp stocking on the floor; at the same time, straps 22 can be grasped and pulled to draw the hollow form 14 along the floor surface and over the person's toes. Straps 22 are long enough that the person can perform this process without stooping or bending.

The pulling action on straps 22 can be continued, such that annular form 14 moves over (around) the person's foot and then upwardly along the person's leg. As form 14 moves up the person's leg it draws the attached stocking over the foot and up on the leg surface. When the stocking is at or neat its final position on the person's foot, the pulling action on straps 22 will be discontinued. Thereafter the straps can be detached from the stocking by disconnecting fastener elements 24 from the mating fastener elements 20. As a final step the mating fastener elements 18 can be disconnected to enable the flexible form 14 to be removed from the person's leg.

The apparatus is useful primarily for drawing the stocking onto and over the person's foot, without requiring the person to reach an excessively long distance in order to place the stocking around the person's toes. Persons afflicted with back problems can manipulate the stocking without having to bend or stoop over. The person therefore avoids the pain and stress that often accompanies such bending and stooping.

Figure 3:
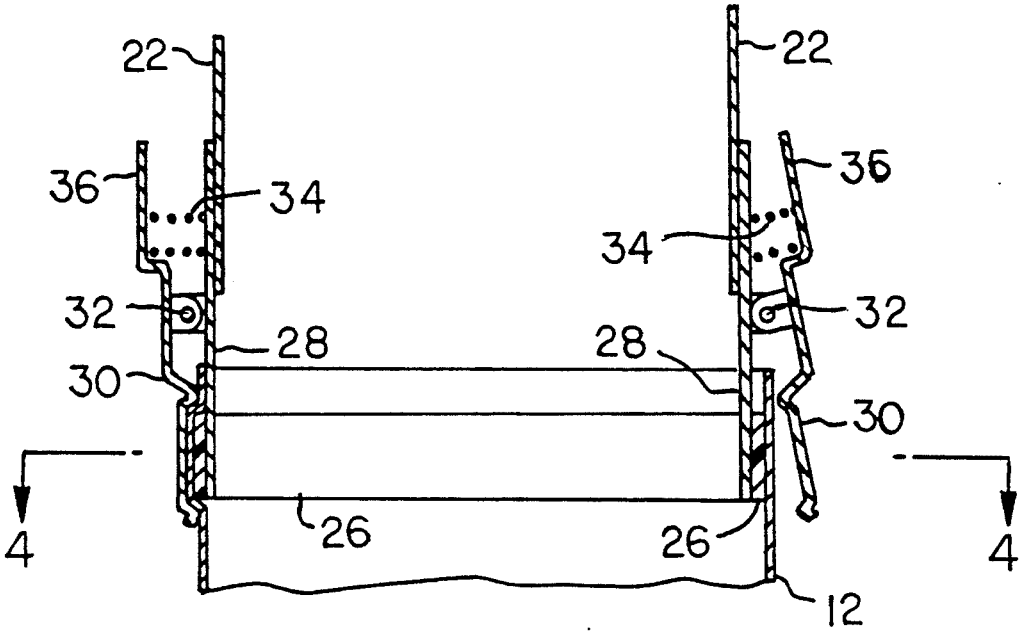
FIG. 3 is a view taken in the same direction aa FIG. 1, but showing another construction embodying the invention.
Figure 4:
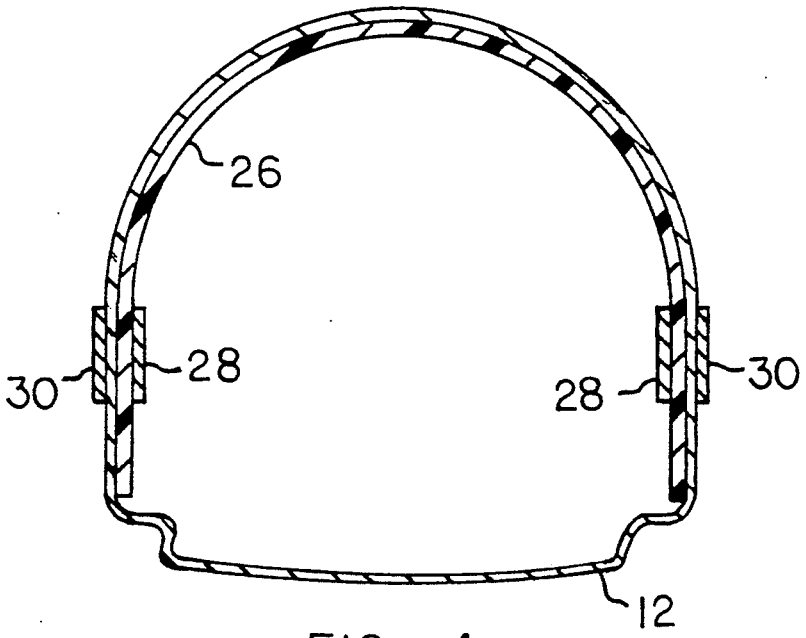
FIG. 4 is a sectional view taken on line 4—4 in FIG. 3.

FIGS. 3 and 4 illustrate another form that the invention can take. As shown, the apparatus comprises a strip or band of plastic material 26 having an arcuate hollow configuration (as viewed in FIG. 4) whereby the strip constitutes a form having an equivalent function to band 14 (FIG. 1). At diametrically spaced points along plastic strip 26 there are two upstanding plates 28; each plate is attached to an elongated flexible strap 22; only part of each strap is shown in FIG. 3.

Each plate 28 pivotably supports a clamp element 30 for swinging motion around pivot axis 32. A coil spring 34 normally biases the associated clamp element 30 to a position for clamping the stocking 12 fabric against the outer surface of form 26. The clamp element 30 can be opened by manual pressure on the thumb actuator portion 36 of the clamp element. In FIG. 3, the rightmost clamp element is shown in its opened position, and the leftmost clamp element is shown in its closed (clamped) position.

The apparatus of FIGS. 3 and 4 is used in the same fashion as the apparatus of FIGS. 1 and 2, to facilitate the process of putting on a stocking. The FIG. 3 apparatus differs from the FIG. 1 apparatus in that arcuate form 26 is not annular. However, form 26 has sufficient curvature that when the upper edge of the stocking is clamped to the form there is provided a space of sufficient size to readily accommodate the toe area of the person's foot. Straps 22 are pulled to draw the stocking over the foot and onto the person's leg.

The drawings show two forms that the invention can take. However, it will be appreciated that the invention can be practiced in other forms.

What is claimed is:

1. Apparatus for assisting a person in inserting a human foot into a stocking, comprising:

an arcuate hollow form adapted to encircle a person's leg below the knee; said arcuate form having two end sections adapted to overlap each other, and cooperable mating snap fastener elements carried by said end sections for releasably attaching said sections together so as to provide an openable arcuate annular form;

said arcuate form having a stiffness so as to be insertable into a stocking, whereby an opening is provided within the form to receive a person's foot;

said arcuate form having two stocking attachments areas spaced apart for disposition along side surface areas of a person's leg;

two elongated straps; and a clamp means carried by each strap for releasably attaching a stocking to said attachment areas on said arcuate form; said straps being locatable along side areas of a person's leg so that after the person has inserted the foot partway into the stocking, the straps can be pulled upwardly to draw the stocking over the foot and around the person's leg.

2. Apparatus according to claim 1, wherein each said attachment area comprises a first snap fastener element; each said clamp means comprising a second mating snap fastener element adapted to interlock with said first fastener element when a stocking fabric is positioned therebetween.

3. Apparatus according to claim 2, wherein one of said interlocking fastener elements is a male fastener element, and the other interlocking fastener element is a female fastener element.

4. Apparatus according to claim 2, wherein said arcuate form comprises an arcuate band having an inner surface and an outer surface; each said first snap fastener element being affixed to the outer surface of said band; each flexible strap having an inner face and an outer face; each said second snap fastener element being affixed to the inner surface of an associated strap, whereby the mating fastener elements can be interlocked by applying a manual squeezing force to the inner surface of said band and the outer surface of an associated strap.

* * * * *